US007214459B2

(12) United States Patent
Iizuka et al.

(10) Patent No.: US 7,214,459 B2
(45) Date of Patent: May 8, 2007

(54) TONER FOR DEVELOPING ELECTROSTATIC CHARGED IMAGES AND DEVELOPER FOR DEVELOPING ELECTROSTATIC CHARGED IMAGES, AND IMAGE FORMING METHOD USING THE SAME

(75) Inventors: Akihiro Iizuka, Minamiashigara (JP); Atsuhiko Eguchi, Minamiashigara (JP); Masahiro Okita, Minamiashigara (JP); Yasuhiro Oya, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 434 days.

(21) Appl. No.: 10/935,134

(22) Filed: Sep. 8, 2004

(65) Prior Publication Data

US 2005/0164109 A1 Jul. 28, 2005

(30) Foreign Application Priority Data

Jan. 28, 2004 (JP) ..... 2004-020090

(51) Int. Cl.
*G03G 9/00* (2006.01)

(52) U.S. Cl. ..... 430/108.1; 430/108.6; 430/110.3; 430/110.1; 430/125

(58) Field of Classification Search ..... 430/108.1, 430/108.6, 110.3, 110.1, 125
See application file for complete search history.

(56) References Cited

U.S. PATENT DOCUMENTS 4,883,736 A 11/1989 Hoffend et al.

FOREIGN PATENT DOCUMENTS

| | | |
|---|---|---|
| JP | A 62-184469 | 8/1987 |
| JP | A 63-188158 | 8/1988 |
| JP | A 2-302772 | 12/1990 |
| JP | A 4-1773 | 1/1992 |
| JP | A 4-212190 | 8/1992 |
| JP | A 5-94113 | 4/1993 |
| JP | A 5-265360 | 10/1993 |
| JP | A 6-282096 | 10/1994 |
| JP | A 9-6049 | 1/1997 |
| JP | A 2000-89502 | 3/2000 |
| JP | A 2001-42562 | 2/2001 |

*Primary Examiner*—Mark A. Chapman
(74) *Attorney, Agent, or Firm*—Oliff & Berridge, PLC

(57) ABSTRACT

The invention provides a toner for developing electrostatic charged images comprising toner mother particles containing a binder resin and a colorant, and an external additive, wherein: the average of shape factors SF1 of the toner mother particles represented by the following Formula (1) is 140 or less; the external additive contains higher alcohol particles having a volume-average particle diameter of 1 to 12 μm; and the content of the higher alcohol particles having a diameter equal to or less than the volume-average particle diameter of the toner mother particles is in a range of 0.15 to 2.5 parts by weight with respect to 100 parts by weight of the toner mother particles. In addition, the invention provides a developer for developing electrostatic charged images comprising the toner. Further, the invention provides an image forming method using the toner.

15 Claims, 1 Drawing Sheet

TONER FOR DEVELOPING ELECTROSTATIC CHARGED IMAGES AND DEVELOPER FOR DEVELOPING ELECTROSTATIC CHARGED IMAGES, AND IMAGE FORMING METHOD USING THE SAME

CROSS-REFERENCE TO RELATED APPLICATION

This application claims priority under 35 USC 119 from the disclosure of Japanese Patent Application No.2004-20090, which is incorporated by reference herein.

BACKGROUND OF THE INVENTION

1. Field of the Invention

The present invention relates to a toner for developing electrostatic charged images and a developer for developing electrostatic charged images used for forming electronic photographs in electrophotographic and electrostatic recording processes, and the like, and an image forming method using the same.

2. Description of the Related Art

An electrophotographic process is a process comprising: developing an electrostatic latent image formed on the surface of a latent image bearing body (photoreceptor) with a toner containing a colorant, transferring the toner image onto a surface of a recording medium; fixing the image thereon with a fixing means such as a heat roller or the like; and additionally removing the toner remaining on the latent image bearing body after transfer and cleaning the bearing body before forming the next electrostatic latent image once again. Dry-type developers used in these electrophotographic processes and the like are grossly classified into one-component developers, wherein a toner contains a mixture of binder resin and a colorant and others is used alone, and two-component developers containing a mix of both a toner and a carrier. The one-component developers can be further classified into: one-component magnetic developers, containing a magnetic powder that is carried by the magnetic force of a developer bearing body for development; and one-component nonmagnetic developers, not containing a magnetic powder, but which are that is electrostatically charged by a charging means, such as a charging roll or the like, and thus carried by a developer bearing body for development.

From the latter half of the 1980s, in the trend toward digitalization, there have existed strong demands in the electrophotographic market for miniaturization and higher-performance. With regard to the quality of full color images, higher image quality has been desired, up to a level similar to high-quality printing and photographs. In addition, in regard to the quality of black and white images, there exists demands for higher image quality and at the same time, for higher-productivity, miniaturization, and cost reduction. Digitalization of processing is an indispensable tool for obtaining high quality images. A stated advantage of digitalization in regard to high quality image is, for example, that complicated image data can be processed at higher speed. By digitalization, characters and photographic images can be processed separately, and the reproducibility of both has been improved significantly compared with analog technology. Particularly in regard to photographic images, the enabling of gradation and color corrections, and digital processing is more advantageous in contrast, definition, sharpness, color reproducibility, and graininess of images than analog processing. An electrostatic latent image formed in the optical system reads to output faithfully as a printed image, and accordingly the particle size of toners used continues to get smaller and smaller in size in order to faithfully reproduce the electrostatic latent images. On the other hand there are demands for; reduction in the number of parts, for the purpose of miniaturization; and for the elongation of the life of consumables, for the purpose of cost reduction, this makes it is necessary to improve the performance and reliability of the developers. Further, the speed of the latent image bearing body is increasing in order to improve productivity, and thus for obtaining higher-quality images consistently, it is becoming extremely important to improve each of the process of development, transfer, fixing, and cleaning. At the same time, it is becoming important to improve the performance, such as the life of consumables by means of components of the toner.

In particular for obtaining higher-quality images, it is necessary in the transfer process to transfer a developed toner image more faithfully, but toners having a smaller diameter often decrease transfer property. Accordingly, various techniques have been reported for utilizing such smaller-diameter toners more efficiently. For example, a method of improving the transferring performance of a toner by making the toner more spherical is disclosed (see e.g., Japanese Patent Application Laid-Open (JP-A) No. 62-184469). In such a case, making the toner more spherical may improve transfer efficiency, but it leads to improper cleaning due to a small amount of the toner remaining thereon after transfer. Alternatively, a cleaner-less system wherein the toner remaining on the photoreceptor surface after transfer is recovered at the same time as the development of images in the developing device is proposed (see e.g., JP-A Nos. 2-302772 and 5-94113). However, due to the difference in electrostatic property between recovered and fresh toners, the recovery of the residual toner at the same time as the development generally causes problems, such as accumulation in the developing device of the recovered toner, which is less easily developed. This consequently leads to deterioration in image quality over time and so generally at least one cleaning system is necessary.

On the other hand, various methods of removing spherical toners are proposed. For example, if the photosensitive carrier is cleaned with a blade it is critically important how the frictional force at the blade nip with the photoreceptor surface, there on which the residual toner particles are present after transfer, is controlled, and thus a method of applying lubricant particles to the blade surface is proposed (see e.g., JP-A No. 4-212190). According to the method, the cleaning is indeed improved initially, but the lubricant particles on the blade surface may be exhausted during use for an extended period of time, causing improper cleaning. Alternatively, a method of applying direct current and alternate current bias voltages to the cleaning blade is proposed (see e.g., JP-A No. 5-265360). However, the amount of static charge on the toner remaining after transfer varies according to the amount of static charge on the developer toner, transfer conditions, the environment of use, or the kind of images formed, and hence the application of a voltage does not assure complete cleaning. Also the cleaning bias may sometimes accelerate deterioration of the photoreceptor surface, reducing the life of the photoreceptor.

Alternatively, increasing the pressure between cleaning blade and photoreceptor is proposed (see e.g., JP-A No. 4-001773), but although such an increase in pressure initially improves the cleaning performance significantly, however, if the material and physical properties of the blade are not examined thoroughly, it may cause defects in the blade resulting in incidences of improper cleaning. Also if an organic photoreceptor is used, the amount of the abrasion of the photoreceptor may increase, reducing the life of the photoreceptor.

On the other hand, as an approach for improvement from the developer perspective, adding a fatty acid metal salt to the toner is proposed (see e.g., JP-A No. 2000-89502). However this method, although effective in reducing the frictional force at the nip portion between the cleaning blade and the photoreceptor, may decrease the amount of static charge on toner significantly due to the addition of a fatty acid metal salt, increasing the likelihood of fogging and toner scattering during image development, thereby decreasing image quality.

Further, a method for the addition of a higher alcohol or a higher fatty acid to the toner is also proposed (see e.g., JP-A No. 63-188158), wherein suppression of toner spotting is achieved by use of a higher alcohol having 30 to 300 carbon atoms is discussed. Suppression of comets and filming on the surface of a photoreceptor by addition of a higher alcohol onto blade cleaning systems by various methods is also examined (see e.g., JP-A Nos. 6-282096 and 9-6049). The suppression is explained therein as the result of the fact that, during cleaning, the higher alcohol or fatty acid forms a film of a releasing agent on the surface of the photoreceptor, thereby suppressing filming of the toner and other toner constituent materials directly on the photoreceptor. However, it is necessary to add a large amount of higher alcohol or higher fatty acid in order to form a sufficiently thick lubricant coating, the accompanying effect of which is shown to be improper charging of the toner and a decrease in the surrounding stability (see e.g., JP-A No. 2001-42562). Therefore, a use of a higher alcohol or higher fatty acid having a number of carbon atoms in the range of 21 to 29 is proposed as an improved method of forming a lubricant coating on the photoreceptor easily with an addition of a small amount. However, such a higher alcohol softens readily, and whilst the lubricant surface may be formed more easily, the use of such a higher alcohol often leads to: problems of significant staining of the development sleeve, charged blade, and the like, by the carriers in two-component developers or by the one-component developers; or decrease in the charge retention of the developer.

If the shape of toner is made more spherical to raise the transfer performance when using smaller-diameter toners for the purpose of obtaining higher-quality images, it becomes more difficult to clean the photoreceptor, and thus it is necessary to remove the toner remaining on the photoreceptor after transfer, for example, by raising the linear pressure of the blade. However, raising the linear pressure also causes the problem of accelerated abrasion of the photoreceptor and the blade. Accordingly, it is necessary to improve the cleaning ability without a sacrifice in the electrostatic performance and the ability to retain electrostatic charge.

In particular, in a system for forming color images, wherein an intermediate transfer body is used for transferring images, two kinds of transfers are required, i.e., a primary transfer of transferring an image of the latent image bearing body onto the intermediate transfer body and a secondary transfer of retransferring the image on the intermediate transfer body onto a recording medium. Hence, the cleaning ability with respect to remaining toner on the latent image bearing body as well as on the intermediate transfer body becomes important. In particular, requirements become stricter for color image forming, as it is necessary to remove toners of multiple colors remaining on the intermediate transfer body. Furthermore, tandem system in which latent image bearing bodies and developer bearing bodies corresponding to the four colors of toner are provides and images thereon are transferred either via an intermediate transfer body or directly onto a recording medium, are advantageous from the viewpoints of total transfer efficiency and printing speed. However, such systems should have a corresponding high speed cleaning process compatible with the high-speed processing.

Further, for obtaining high-quality images, where there is an addition of some microparticles of a fatty acid metal salt, higher alcohol, higher fatty acid, or the like for improving the cleaning ability, this is often accompanied with irregularity in closely solid images and half tone images due to inappropriate transfer. These irregularities stand out more in color images with high image density, resulting in a marked decrease in image quality.

SUMMARY OF THE INVENTION

The present invention has been made in view of the above circumstances and, considering the need for high-quality images at a high transfer efficiency, provides: a toner for developing electrostatic charged images and a balanced developer for developing electrostatic charged images with improved cleaning characteristics, suppression of defects in image quality such as image unevenness, and the like. At the same time, the present invention provides increased reliability due to a reduction in the friction between blade and photoreceptor. The present invention provides an image forming method using the same.

After intensive studies, the present inventors have found that it is possible to achieve high quality images at a high transfer efficiency by using the following inventions as the toner and the developer for developing the electrostatic latent images formed on a surface of a latent image bearing body and the image forming method using the same.

Namely, a first aspect of the present invention is a toner for developing electrostatic charged images comprising toner mother particles containing a binder resin and a colorant, and an external additive, wherein: the average of shape factors SF1 of the toner mother particles represented by the following Formula (1) is 140 or less; the external additive contains higher alcohol particles having a volume-average particle diameter of 1 to 12 μm; and the content of the higher alcohol particles having a diameter equal to or less than the volume-average particle diameter of the toner mother particles is in a range of about 0.15 to 2.5 parts by weight with respect to 100 parts by weight of the toner mother particles.

$$SF1=(L^2/A)\times(\pi/4)\times 100 \qquad \text{Formula (1)}$$

In Formula (1), L represents the maximum length of each toner mother particle; and A represents the projected area of each toner mother particle.

A second aspect of the present invention is a developer for developing electrostatic charged images comprising the toner.

Further, the third aspect of the present invention is an image forming method using the toner, comprising: charging a photoreceptor to form a latent image on a latent image bearing body; developing the latent image on a developer bearing body by using the toner; transferring the developed image; and cleaning comprising removing the remaining toner on the latent image bearing body.

The toner according to the invention for developing electrostatic latent images allows, in a balanced manner, improvement in cleaning property and suppression of defects in image quality such as image unevenness and the like at the same time, and improvement in reliability due to decrease in the friction between blade and photoreceptor, for the purpose of obtaining high-quality images at a high transfer efficiency.

In addition, the developer for developing electrostatic charged images and the image forming method according to the invention, which utilize the toner for developing electrostatic charged images according to the invention, exert a similar advantageous effect.

BRIEF DESCRIPTION OF THE DRAWINGS

Preferable embodiments of the present invention will be described in detail based on the following FIGURE.

DETAILED DESCRIPTION OF THE INVENTION

Figure 1:
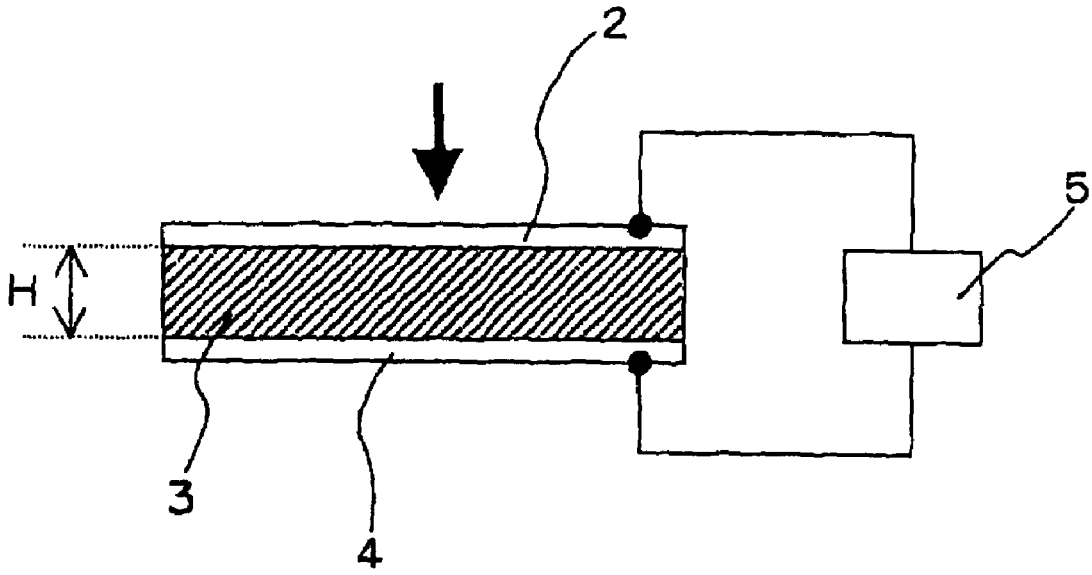
FIG. 1 is a schematic view illustrating the method of measuring the volumetric resistivity of a carrier.

Hereinafter, the toner for developing electrostatic charged images, the developer for developing electrostatic charged images and the image forming method according to the present invention will be described in detail.

Toner for Developing Electrostatic Charged Images

The toner according to the invention for developing electrostatic charged images (hereinafter, referred to simply as "toner") contains toner mother particles and external additive, with the average of shape factor SF1 of the toner mother particles being 140 or less. The external additive contains higher alcohol particles having a volume-average particle diameter of about 1 to 12 μm, and the content of the higher alcohol particles having a diameter equal to or less than the volume-average particle diameter of the toner mother particles is in a range of about 0.15 to 2.5 parts by weight with respect to 100 parts by weight of the toner mother particles.

Toners are needed to be made nearly spherical in order to obtain higher transfer efficiency. For that reason, the shape factor SF1 of the toner mother particles contained in the toner for developing electrostatic images according to the invention is 140 or less.

However, considering the cleaning mechanism, the following problems are liable to arise. For example, when cleaning by using a blade, the toner remaining after transfer is blocked at the blade nip portion, like a stream blocked by a dam. The dam of toner, toner particles are continuously sorted according to the diameter thereof, and as a result, particles tend to get smaller the closer they are to the blade. Although such particle sorting according to particle diameter may be observed at the blade nip portion independent of the shape of toner particles, but the sorting effect becomes more significant as the toner particles become more spherical. In such a case, the number of toner particle micro contact points per unit area of the photoreceptor surface at the blade nip portion increases and, since the frictional forces of respective toner particles are aligned in the same direction, the sum of the frictional forces applied to the blade during cleaning becomes significantly large. As a result, the blade is pushed away or the blade edge is damaged, as allowing the toner to sneak through and resulting in improper cleaning. If the linear pressure of the blade is raised to suppress the improper cleaning even when a nearly spherical toner is used, the frictional force between the blade and the photoreceptor increases, resulting in significant increased abrasion of the photoreceptor surface.

Accordingly for cleaning of the nearly spherical toner, it is important to reduce the frictional force at the blade nip portion between toner and photoreceptor. It is common practice to supply higher alcohol particles to the cleaning blade surface, and thus form a lubricant surface on the photoreceptor surface, by adding higher alcohol particles to the toner mother particles. However it is necessary to add a significant amount of higher alcohol particles to toner mother particles in order to effectively reduce the frictional force at the blade nip portion, consequently leading to a significant decrease in the electrostatic performance of the toner. Attempts to facilitate the formation of the lubricant surface by the use of the particles of a higher alcohol having reduced molecular weights, which soften more easily, lead to staining of the carrier, charged sleeve, and charged blade as described above, and thus to significant decrease in charge retention.

However, the present inventors have found that by defining the relationship between the diameter of toner mother particles and the diameter of the higher alcohol particles added, and determining the content of the higher alcohol particles having a particular particle diameter, it is possible to at the same time provide a toner for developing electrostatic charged images, a developer for developing electrostatic charged images and an image forming method using the same that does not affect the electrostatic properties of relevant units; and enables the formation of a favorable lubricant surface on the photoreceptor surface, eliminating improper cleaning.

In order to form a lubricant surface of the higher alcohol on the photoreceptor surface, it is important to decide how to supply the higher alcohol particles to the neighborhood of the blade. It has been found that it is possible to provide a developer free from improper charging and with good charge retention, by skillfully using the phenomenon described above whereby the toner remaining after transfer is blocked at the blade nip portion, like a stream blocked by a dam, and in the dam of toner, the toner particles are continuously mixed and sorted according to the diameter thereof, and as a result, particles tend to get smaller the closer they are to the blade. By controlling the amount of higher alcohol particles having a diameter of the volume-average diameter of toner mother particles or less, efficiently supplying the higher alcohol selectively to the edge of the blade, thus forming an effective lubricant surface on the photoreceptor surface, whilst restricting the total amount of higher alcohol added and retaining the softening point of the higher alcohol. Thus at the same time, it has become possible to reduce the frictional force between blade and photoreceptor and suppress the abrasion of photoreceptor, by forming a satisfactory lubricant surface on the photoreceptor surface.

In this manner, it has become possible to provide a well balanced toner for developing electrostatic charged images, a developer for developing electrostatic charged images and, an image forming method using the same with: improved cleaning ability and reliability, due to the decrease in the friction between the blade and the photoreceptor; free from image defects such as image unevenness and the like; and providing high-quality images due to a high transfer efficiency.

Toner Mother Particle

A toner mother particle contains a binder resin and a colorant, and additionally a releasing agent, silica, charge-controlling agent, or the like as needed.

Examples of the binder resins include homopolymers and copolymers of styrenes such as styrene and chlorostyrene; monoolefins such as ethylene, propylene, butylene, and isoprene; vinyl esters such as vinyl acetate, vinyl propionate, vinyl benzoate, and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinylmethylether, vinylethylether, and vinylbutylether; vinyl ketones such as vinylmethylketone, vinylhexylketone, and vinylisopropenylketone; and the like. Typical examples of the binder resins include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, polypropylene, and the like. Specific examples thereof further include polyester, polyurethane, epoxy resins, silicone resins, polyamide, modified rosins, paraffin waxes, and the like. Among them, styrene-alkyl acrylate copolymers and styrene-alkyl methacrylate copolymers are particularly preferable.

Typical examples of the colorants for the toner mother particles include magnetic powder such as magnetite and ferrite, carbon black, aniline blue, Calco Oil Blue, chromium yellow, ultramarine blue, Du Pont Oil Red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, C.I. Pigment Blue 15:3, and the like.

For production of the toner mother particles, for example, may use the following processes: a kneading-pulverizing process wherein a binder resin and a colorant, and additionally as needed a releasing agent, a charge-controlling agent, or the like are kneaded, pulverized, and classified; a method wherein the shape of the particles obtained in the kneading-pulverizing process is modified by using mechanical impulsive force or thermal energy; an emulsion polymerization coagulation method wherein a polymerizable monomer for binder resin is emulsion-polymerized, and the dispersion thus formed is mixed with a dispersion of a colorant, and additionally as needed a releasing agent, charge-controlling agent, or the like, then coagulated, and heat-fused to obtain toner particles; a suspension polymerization process wherein polymerizable monomer for binder resin and a colorant, and as needed, a releasing agent, charge-controlling agent, and the like is suspended in an aqueous solvent, and the polymerizable monomer are polymerized in the dispersion; a solubilization suspension process wherein a polymerizable monomer for binder resin and a solution containing a colorant and as needed, a releasing agent, charge-controlling agent, or the like are suspended in an aqueous solvent, and the resulting mixture is granulated; and the like.

In addition, particles having a core and shell structure may be produced by using the toner mother particles obtained in the processes above as the core particle, additionally adhering coagulation particles thereto, and heat-fusing the coagulated particles.

The particle diameter of the toner mother particles produced is preferably in the range of about 2 to 12 μm, more preferably in the range of about 3 to 9 μm as volume-average particle diameter.

The volume-average particle diameter can be determined, for example, by dispersing the particles in water with a surfactant and measuring by using a Coulter counter.

As described above, the toner mother particles according to the invention should be pseudo-spherical, from the viewpoints of improving the development and the transfer efficiency of the toner and improving the quality of formed images. Namely, when the sphericity of the toner mother particles is expressed by shape factor SF1 of following Formula (1), the average of the shape factors SF1 of the toner mother particles according to the invention should be about 140 or less, and is preferably in the range of about 115 to 140 and more preferably in the range of about 120 to 140.

$$\text{Shape factor of toner mother particles: } SF1=(L^2/A)\times(\pi/4)\times 100$$

In the formula above, L represents the maximum length of each toner mother particle; and A represents a projected area of each toner mother particle.

Toner mother particles having an average of shape factors SF1 of more than 140 leads to decrease in transfer efficiency, often resulting in visually observable decrease in the image quality of printed samples.

The average of shape factors SF1 is determined by incorporating images of 1000 toner particles obtained at a magnification of 250 times in an optical microscope into an image-analyzing instrument (trade name: LUZEXIII, manufactured by Nireco Corporation), measuring the maximum length and the projected area of each particle, calculating the SF1 of each particle, and obtaining the average thereof.

Processes for producing the toner mother particles according to the invention are not particularly limited, and any known production processes may be used, as long as the toner mother particles meet the requirements of the shape factor SF1 and the particle diameter above.

It is generally understood in the art that a higher alcohol is an alcohol which has 6 or more of carbon atoms. The higher alcohol particles contained in the toner have a volume-average particle diameter of about 1 to 12 μm, and the number of carbon atoms in the higher alcohol is not particularly limited, but higher aliphatic alcohols and the like having about 16 to 150 carbons are favorably used. The number of carbon atoms is more preferably about 20 to 120, and still more preferably about 30 to 100.

In the total amount of the higher alcohol particles added to toner mother particles, the amount of higher alcohol particles having a diameter of the volume-average diameter of toner mother particles or less is 0.15 part by weight or more with respect to 100 parts by weight of toner mother particles, and thus the total amount of the higher alcohol particles added to the toner mother particles is not particularly limited generally. However, in the invention, the total amount of higher alcohol particles added is in the range of about 0.15 to 2.5 parts by weight with respect to 100 parts by weight of toner mother particles.

On the other hand, the content of higher alcohol particles having a diameter of the volume-average diameter of toner mother particles or more (with respect to 100 parts by weight of toner mother particles) is preferably about 2.5 parts by weight or less, and more preferably about 2 parts by weight or less. For full color imaging, the content of the higher alcohol particles having a diameter of the volume-average diameter of toner mother particles or more is preferably about 2.0 parts or less and more preferably about 1.8 parts by weight or less.

The reason for defining the content of higher alcohol particles having a diameter of the volume-average diameter of toner mother particles or more is that the relationship between the diameter of toner mother particles and the diameter of higher alcohol particles has been found to be important for the purpose of obtaining high quality images.

Although resin microparticles such as higher alcohol particles do not affect image quality per se, as they are not colored, in printing images such as color images, frequently containing half tone images and solid images, wherein the content of the resin microparticle having a diameter of more than the diameter of toner particle increases, such resin microparticles increase the distance between the photoreceptor and the intermediate transfer body or the recording medium in the transfer nip region. This increase in distance leads to a weakening of the transfer electric field in the neighborhood and thus makes not only the resin microparticles but also the toner particles in the neighborhood less transferable. As a result, such areas are less dense than normally transferred areas, and the images may have more transfer irregularities. Therefore, it has been found to be important to define the amount of the higher alcohol particles added having a diameter of the volume-average diameter of toner mother particles or more, to ensure high quality images are obtained.

For adjustment of the content of the higher alcohol particles having a diameter of the volume-average diameter of toner mother particles or less, or of the content of the toner mother particles having a diameter of the volume-average particle diameter of the higher alcohol particles or more, it is preferably to pulverize then classify the higher alcohol particles, thereby adjusting the grain size distribution of the higher alcohol particles for use.

The shape factor SF1 of the higher alcohol particles is preferably 140 or more, for obtaining a better cleaning process. By controlling the shape factor to 140 or more, it becomes possible to suppress sneaking of the higher alcohol particles through the blade at the blade edge portion and to form an efficient lubricant surface on the photoreceptor surface, by forming a dam of higher alcohol particles at the blade nip portion. The shape factor SF1 of the higher alcohol particles can be determined in a similar manner to the shape factor SF1 of toner mother particles.

To the higher alcohol particles added to the toner, additional lubrication particles may be added. Examples thereof include solid releasing agents such as graphite, molybdenum disulfide, talc, fatty acids, aliphatic alcohols, and fatty acid metal salts; low-molecular weight polyolefins such as polypropylene, polyethylene, and polybutene; silicones that soften by heating; aliphatic amides such as oleic amide, erucic amide, recinoleic amide, and stearic amide; vegetable waxes such as carnauba wax, rice wax, candelilla wax, Japan tallow, and jojoba oil; animal waxes such as bee wax and the like; mineral and petroleum waxes such as montan wax, ozokerite, ceresin, paraffin wax, microcrystalline wax, and Fischer-Tropsch wax; and modified combinations thereof.

The external additives for the toner according to the invention include at least the particles of a higher alcohol and may contain any other additives.

A releasing agent and/or a charge-controlling agent may also be added to the toner according to the invention as needed. Typical examples of the releasing agents include low-molecular weight polyethylene, low-molecular weight polypropylene, Fischer-Tropsch wax, montan wax, carnauba wax, rice wax, candelilla wax, and the like.

Any known compounds may be used as the charge-controlling agent, and examples thereof include azo metal complex compounds, salicylic acid metal complex compounds, resin-type charge-controlling agents containing a polar group. When toners are produced in wet production processes, use of materials not readably soluble in water is preferable, from the viewpoints of controlling ionic strength and reduction of wastewater pollution. The toner according to the invention may be either a magnetic toner, containing a magnetic material; or a nonmagnetic toner, not containing a magnetic material.

It is also favorable to add an additive that is effective in controlling the powder fluidity and the charge on the toner particles. Specifically, smaller inorganic oxide particles having a primary particle diameter of 7 to 40 nm as volume-average particle diameter are preferable.

The smaller inorganic oxide particles include, for example, silica, alumina, titanium oxide (titanium oxide, metatitanic acid, etc.), calcium carbonate, magnesium carbonate, calcium phosphate, carbon black, and the like.

In particular, use of titanium oxide having a volume-average particle diameter of 15 to 40 nm is preferable, as titanium oxide does not affect the transparency and provides favorable electrostatic characteristics, environmental stability, fluidity, and caking resistance leading to stabilized negative-charge propensity as well as consistency in image quality.

In addition, smaller-diameter inorganic microparticles become more dispersible by using surface treatments, and thus can be made more effective in increasing the fluidity of the resulting powders. Specific examples of the surface treatments include hydrophobilization treatments with dimethyldimethoxysilane, hexamethyldisilazane (HMDS), methyltrimethoxysilane, isobutyl trimethoxysilane, decyltrimethoxysilane, and the like.

In addition to the smaller inorganic oxide particles and the higher alcohol particle described above, it is preferable to add larger inorganic oxide particles having a volume-average particle diameter of about 20 to 300 nm, for reducing adhesiveness and controlling electrostatic charge.

Examples of these larger inorganic oxide microparticles include macroparticles of silica, titanium oxide, metatitanic acid, aluminum oxide, magnesium oxide, alumina, barium titanate, magnesium titanate, calcium titanate, strontium titanate, zinc oxide, chromium oxide, antimony trioxide, magnesium oxide, zirconium oxide, and the like. Among them, silica, titanium oxide, or metatitanic acid are preferable for the purpose of precisely controlling the charge on toners containing a lubricant particle and/or cerium oxide.

In addition, monodisperse spherical silica having a true specific density of about 1.3 to 1.9 and a volume-average particle diameter of about 80 to 300 nm is preferable, particularly for those images that require a high transfer efficiency such as full color images and the like. By controlling the true specific density to about 1.9 or less, it becomes possible to suppress peel off from toner mother particles. Further, by controlling the true specific density to about 1.3 or more, it becomes possible to suppress cohesive dispersion. The true specific density of the monodisperse spherical silica described above is more preferably in the range of about 1.4 to 1.8.

Control of the volume-average particle diameter of monodisperse spherical silica to within the range of about 80 to 300 nm can contribute to reducing non-electrostatic adhesion between the toner and the photoreceptor. In particular, it prevents the embedding of monodisperse spherical silica into the toner mother particles by the stress in the developing device, and thus is effective in preserving its advantageous effect of improving development and transfer properties. In addition, control of the particle diameter to within the range above allows prevention of separation of the spherical silica from toner mother particles, and, while effectively reducing the non-electrostatic adhesion of the toner described above, it helps in preventing secondary adverse effects such as charging inhibition, and defects in image quality. The volume-average particle diameter of the monodisperse spherical silica is more preferably about 100 to 200 nm.

Being monodispersed and spherical, the monodisperse spherical silica is dispersed uniformly on the surface of toner mother particles, providing a consistent spacing effect. When the degree of monodispersion is defined by a standard deviation from the average particle diameter of silica particles including the aggregates, the standard deviation is preferably a value of volume-average particle diameter D50 multiplied by 0.22 or less. When the sphericity is defined by Wadell sphericity, the sphericity is preferably 0.6 or more and more preferably 0.8 or more.

The sphericity, i.e., Wadell sphericity, can be determined according to the following formula.

Sphericity=(Surface area of a spherical particle having the same volume as that of actual particle)/(Surface area of actual particle)

In the formula above, the numerator (surface area of a spherical particle having the same volume as that of actual particle) is determined by calculation from the volume-average particle diameter of actual particle. As the denominator (surface area of actual particle), a BET specific surface area determined by using the Shimadzu Particle Specific Surface Area Analyzer SS-100 (trade name) is used.

Silica is preferable because silica, having a refractive index of about 1.5, does not cause a decrease in the transparency due to light scattering, and thus does not affect the PE value (an indicator of light transmittance) especially when an image is formed on OHP surface or the like even if the particle diameter is large.

The amount of the smaller inorganic oxide particles added is preferably in the range of about 0.5 to 2.0 parts by weight with respect to 100 parts by weight of toner mother particles. When the larger inorganic oxide particles above are added together with cerium oxide, the amount of the larger-diameter inorganic oxide added is preferably about 1.0 to 5.0 parts by weight with respect to 100 parts by weight of toner mother particles.

As the toner mother particles according to the invention are pseudo-spherical, effects of the addition of inorganic oxide become superior to those of an addition to irregular toner mother particles. If inorganic oxides are added to toner mother particles in the same amount, then the fluidity of the toner containing pseudo-spherical toner mother particles is much higher than that of the toner containing amorphous toner mother particles. Thus the toner from pseudo-spherical toner mother particles has superior developing and transfer properties, even when the amounts of static charge on each of the toners are of a similar level.

The toner according to the invention may be produced by blending toner mother particles and external additives of higher alcohol particles or the like in a Henschel mixer, V-type blender, or the like. When the toner mother particles are produced in a wet system, these external additives may be added into the wet system.

Developer for Developing Electrostatic Images

The developer for developing electrostatic images according to the invention contains the toner for developing electrostatic images according to the invention described above.

Namely, the developer for developing electrostatic charged images according to the invention (hereinafter, referred to simply as "developer") is produced by mixing the toner described above and the following carrier. The mixing ratio (weight ratio) of the toner to the carrier in developers, toner:carrier, is preferably in the range of about 1:99 to 20:80 and more preferably in the range of about 3:97 to 12:88.

Carrier

Carriers usable in the developer according to the invention are not particularly limited, and any known carriers may be used. Examples of the carrier include a resin-coated carrier having a resin-coated layer on the surface of a core material. Another example thereof is a resin dispersion carrier wherein magnetic powders are dispersed in a matrix resin.

Examples of the coating and matrix resins used in the carrier include, but is not particularly limited to, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resins having an organosiloxane bond and the modified resins thereof, fluorine resins, polyester, polycarbonate, phenol resins, epoxy resins, urea resins, urethane resins, melamine resins, and the like.

Generally, the carrier preferably has a suitable electric resistance, and thus it is preferable to disperse conductive microparticles in the resin for adjustment of the resistance. Examples of the conductive microparticles include metals such as gold, silver, and copper; carbon black, titanium oxide, zinc oxide, barium sulfate, aluminum borate, potassium titanate, tin oxide, carbon black, and the like, but are not limited thereto.

Examples of the core materials for the carrier include magnetic metals such as iron, nickel, and cobalt, magnetic oxides such as ferrite and magnetite, glass bead, and the like, and magnetic materials are preferable if the carrier is used in the magnetic brush process. The volume-average particle diameter of the core materials for carrier is preferably in the range of about 10 to 100 μm, and more preferably in the range of about 25 to 50 μm.

The surface of the core material for carrier is coated with a resin, by applying a coat layer-forming solution wherein a coating resin and various additives as needed are dissolved in a suitable solvent. The solvents are not particularly limited, and suitably selected according to the coating resin used, coating suitability, and the like.

Specific examples of the resin-coating methods include, an immersion method wherein particles of the core material for carrier are immersed in a coat layer-forming solution, a spraying method wherein a coat layer-forming solution is sprayed onto the surface of the core material for carrier, a fluidized bed method wherein a coat layer-forming solution is sprayed onto the core material for carrier floating in fluidizing air, a kneader coater method wherein a core material for carrier and a coat layer-forming solution are mixed in a kneader coater and then the solvent is removed, and the like.

Image Forming Method

Hereinafter, the image forming method according to the invention will be described in detail. The image forming method according to the invention is a process wherein the toner for developing electrostatic charged images according to the invention is used as the toner, comprising: latent image forming to form an electrostatic latent image on a surface of a latent image bearing body; developing to develop the electrostatic latent image formed on the surface of the latent image bearing body into a toner image (developed image) by using a toner carried by a developer bearing body: transferring to transfer the toner image formed on the surface of the latent image bearing body onto the surface of a recording medium or an intermediate transfer body: fixing to heat-fuse the toner image transferred on the recording medium surface; and cleaning to remove the remaining toner on the surface of the latent image-bearing body. Similar advantageous effects may be obtained when the toner carried by the developer bearing body is replaced with the developer for developing electrostatic charged images according to the invention.

The latent image forming is a process wherein after charged uniformly by a charging means, the surface of a latent image bearing body is exposed to an image from a laser optical system, LED array, or the like, and thus the electrostatic latent image is formed. The charging means include any kinds of electrostatic charging devices, including noncontact electrostatic charging devices such as corotrons and scorotrons, and contact electrostatic charging devices wherein a surface of a latent image bearing body is charged by applying a voltage to a conductive element in contact with a surface of a latent image bearing body. However, contact-type electrostatic charging devices are preferable from the viewpoints of the amount of ozone generated, environmental friendliness, and printing durability. In the contact-type electrostatic charging devices, the shape of the conductive elements may be in any shape of brush, blade, pin electrode, roller, or the like, but roller-shaped elements are preferable. In the latent image forming, the image forming method according to the invention is not particularly limited.

The developing above is adhering toner particles to the electrostatic latent image formed on the surface of the latent image bearing body and thus forming a toner image (developed image) on the surface of the latent image bearing body, by bringing the development carrier whereon a developer layer containing at least the toner on the surface into contact with or proximity of the electrostatic latent image, and form a toner image (developed image) on the latent image-bearing. Any known methods may be used as the developing method, and examples thereof by using two-component developers include cascade method, magnetic brush method, and the like. The image forming method according to the invention is not particularly restricted with regard to the developing method.

The transferring is forming a transfer image by transferring the toner image formed on the surface of the latent image bearing body directly or transferring the image once onto an intermediate transfer body and then retransferring the transferred image onto a recording medium.

Corotrons may be used as the transfer unit for transferring the toner image from the latent image bearing body to a paper or the like. Although the corotrons are effective as the means for charging the paper uniformly, it also demands a high-pressure power source, as it is necessary to apply a high pressure of several kV for providing a certain electric charge on the paper (recording medium). As ozone generated by corona discharge causes degradation of rubber parts and the latent image bearing body, contact transfer methods of transferring toner images onto a paper by bringing a conductive transfer roll made of an elastic material into contact with the latent image bearing body are preferable. In the image forming method according to the invention, the transfer unit is not particularly restricted.

The cleaning above is removing the toner, paper powder, dust, and the like adhered to the surface of the latent image bearing body by bringing a blade, brush, roll, or the like into direct contact with the surface of the latent image bearing body.

The most commonly used method is a blade cleaning method of bringing a rubber blade made of polyurethane or the like into contact with the latent image bearing body under pressure. Alternatively, a magnetic brush method of recovering the toner by a magnetic carrier placed on the surface of a cylindrical nonmagnetic sleeve spinning around a fixed magnet inside, and a method of removing the toner by placing a spinning roll of semiconductive resin fibers or animal hairs and applying a bias having the opposite polarity thereto may be used. In the former magnetic brush method, a Corotron may be used for pretreatment before cleaning. The cleaning method in the image forming method according to the invention is preferably a cleaning wherein at least a blade is used.

The fixing above is fixing the toner image transferred on the recording medium surface by a fixing device. Heat-fixing devices employing a heat roll are preferably used as the fixing device. The heat-fixing devices commonly consist of a fixing roller equipped with a heater lamp for heating inside the cylindrical metal roller and having a so-called releaser layer formed around the external surface thereof, i.e., a heat resistant resin-coated layer or heat resistant rubber-coated layer; and a press roller or press belt placed in contact with the fixing roller, having a heat-resistant elastic layer formed on the external surface or on the belt-shaped base support surface. In the process of fixing unfixed toner images, a recording medium whereon the unfixed toner image is formed is passed through a slit between the fixing roller and the press roller or press belt, and the image is fixed by thermal fusion of the binder resin, additives, and the like in the toner. In the image forming method according to the invention, the fixing method is not particularly restricted.

When full color images are to be formed by the image forming method according to the invention, preferable is an image forming method wherein multiple latent image bearing bodies have developer bearing bodies in colors of their own; multiple toner images in respective colors are transferred one by one onto the same recording medium surface sequentially in a series of the processes consisting of a latent image forming, developing, transferring and cleaning by the respective latent image bearing bodies and developer bearing bodies; and the superimposed full-color toner image is then heat-fused in the fixing. Use of the developer for developing electrostatic charged images in the image forming method leads to, for example, more stabilized development, transfer and fixation of images in tandem image forming apparatuses smaller in size and higher in color image-processing speed.

Examples of the recording media whereon toner images are transferred include plain papers, OHP sheets, and the like commonly used in copying machines, printers, and the like by the electrophotographic process. The surface of the recording media is preferably smoother for further improving the surface smoothness of images after fixing, and high-grade papers such as coated papers whereof the surface is coated with a resin or the like, art papers for printing, and the like are favorably used.

The image forming method using the toner for developing electrostatic charged images according to the invention enables an improvement in cleaning property and suppression of defects in image quality such as image unevenness and the like at the same time in a balanced manner, and further enables an improvement in reliability due to decrease in the friction between blade and photoreceptor, so as to provide high-quality images at a high transfer efficiency.

EXAMPLES

Hereinafter, the present invention will be described in more detail with reference to Examples, but it should be understood that the invention is not restricted to these Examples. In the description below, the "parts" means "parts by weight", until specified otherwise.

Methods of Determining Physical Properties Grain Size Distribution of Toner Mother Particles and External Additives The grain size distribution is evaluated by using a grain size distribution analyzer (trade name: Multisizer, manufactured by Beckman-Coulter Co., Ltd.) having an aperture diameter of 100 μm.

Measurement of the Amount of Static Charge on Toner (1) The amounts of static charge at high temperature and high humidity and at low temperature and low humidity are evaluated by storing both a toner composition and a carrier for 24 hours under an high temperature and high humidity condition: 30° C. and 90% RH and under an low temperature and low humidity condition: 5° C. and 10% RH, placing the toner composition and the carrier in capped glass bottles respectively at an TC [TC (% by weight)=Toner weight÷(Toner weight+Carrier weight)×100] of 5% by weight, stirring in a mixer (trade name: Turbla Mixer, manufactured by Dae Hua Tech) under respective conditions, and measuring the stirred developer under a condition of 25° C. and 55% RH by using TB200 (trade name, manufactured by Toshiba Corporation).

(2) In evaluation tests in commercial apparatuses, the amount of static charge is evaluated by collecting a developer on the magnetic sleeve of the developing device and measuring the charge in the similar manner to above under a condition of 25° C. and 55% RH by using TB200 (trade name, manufactured by Toshiba Corporation).

About 0.3 to 0.7 g of the developer on the sleeve (developer bearing body) surface of the developing device is collected and the amount of static charge is evaluated by using a measuring device (trade name: TB200, manufactured by Toshiba Corporation) according to the blow off method.

Image Density

The image density is evaluated by using an image densitometer (trade name: X-Rite 404A, manufactured by X-Rite Inc.).

Volumetric Resistivity of Carriers

A sample of a carrier is filled in a cell (100 mmϕ, thickness: 1.0 mm) over the lower electrode therein, and after the upper electrode is placed, a load of 3.43 kg is applied to the sample and the thickness is evaluated by using a dial gauge. Subsequently, a voltage is applied and the volumetric resistivity is evaluated by reading the electric current.

Wadell Sphericity

Sphericity=(Surface area of a spherical particle having the same volume as that of actual particle)/(surface area of actual particle)

In the formula above, the "surface area of a spherical particle having the same volume as that of actual particle" is evaluated by calculation from the volume-average particle diameter of the actual particle. A BET specific surface area obtained by using Shimadzu Powder Specific Surface Area Analyzer SS-100 is used as the "surface area of actual particle".

Evaluation of Resistance

As shown in FIG. 1, a test sample 3 having a thickness of H is placed between the lower electrode 4 and the upper electrode 2, and the thickness is evaluated under load from above by using a dial gauge, and the electric resistance of the test sample 3 is evaluated by a high-voltage resistance meter 5. Specifically, a pressure of 500 kg/cm$^2$ is applied to a particular titanium oxide sample by a pressing machine, to provide a test disc for measurement. Subsequently, after both disc surfaces are cleaned with a brush and placed between the upper electrode 2 and the lower electrode 4 in a cell, the thickness thereof is evaluated by using a dial gauge. Then, the volumetric resistivity is evaluated by reading the electric current flowing when a voltage is applied.

A sample of a carrier is filled in a 100-mmϕ cell over the lower electrode 4 therein, and after the upper electrode 2 is placed, the thickness thereof is evaluated under a load of 3.43 kg by using a dial gauge. Then, the volumetric resistivity is evaluated by reading the electric current flowing when a voltage is applied.

Production of Toner Mother Particles

Preparation of Resin Microparticle Dispersion

To a flask containing 370 parts of styrene, 30 parts of n-butyl acrylate, 8 parts of acrylic acid, 24 g of dodecanethiol, and 4 parts of carbon tetrabromide, a solution of 6 parts of a nonionic surfactant (trade name: Nonipol 400, manufactured by Sanyo Chemical Industries, Ltd.) and 10 parts of another anionic surfactant (trade name: Neogen SC, manufactured by Dai-ichi Kogyo Seiyaku Co., Ltd.) in 550 parts of ion-exchange water is added, and the resulting mixture is emulsified in the flask. 50 parts of ion-exchange water solution containing 4 parts of ammonium persulfate is gradually added thereto over 10 minutes while the mixture is stirred gently. After the flask is purged with nitrogen, the mixture is heated to 70° C. while stirred in an oil bath and additionally heated at the same temperature for 5 hours to continue the emulsion polymerization. As a result, a resin microparticle dispersion containing resin particles having an average particle diameter of 152 nm, a glass transition temperature Tg of 58° C., and a weight-average molecular weight Mw of 11,700 is prepared. The solid matter concentration in the dispersion is 40% by weight.

Preparation of Colorant Dispersion (1)

A dissolved mixture of 60 parts of carbon black (trade name: MOGAL®L, manufactured by Cabot Corporation) and 6 parts of a nonionic surfactant (trade name: Nonipol 400, manufactured by Sanyo Chemical Industries, Ltd.) in 240 parts of ion-exchange water is stirred by using a homogenizer (trade name: Ultra-Turrax T50, manufactured by IKA) for 10 minutes, and then dispersed by using the Ultimizer, to provide a colorant dispersant (1) containing colorant (carbon black) particles having an average particle diameter of 250 nm.

Preparation of Colorant Dispersion (2)

A dissolved mixture of 60 parts of a cyan pigment (B15:3) and 5 parts of a nonionic surfactant (trade name: Nonipol 400, manufactured by Sanyo Chemical Industries, Ltd.) in 240 parts of ion-exchange water is stirred in a homogenizer (trade name: Ultra-Turrax T50, manufactured by IKA) for 10 minutes, and then dispersed by using the Ultimizer, to provide a colorant dispersant (2) containing colorant (cyan pigment) particles having an average particle diameter of 250 nm.

Preparation of Colorant Dispersion (3)

A dissolved mixture of 60 parts of a magenta pigment (R122) and 5 parts of a nonionic surfactant (trade name: Nonipol 400, manufactured by Sanyo Chemical Industries, Ltd.) in 240 parts of ion-exchange water is stirred in a homogenizer (trade name: Ultra-Turrax T50, manufactured by IKA) for 10 minutes, and then dispersed by using the Ultimizer, to provide a colorant dispersant (3) containing colorant (magenta pigment) particles having an average particle diameter of 250 nm.

Preparation of Colorant Dispersion (4)

A dissolved mixture 90 parts of a yellow pigment (Y180) and 5 parts of a nonionic surfactant (trade name: Nonipol 400, manufactured by Sanyo Chemical Industries, Ltd.) in 240 parts of ion-exchange water is stirred in a homogenizer (trade name: Ultra-Turrax T50, manufactured by IKA) for 10 minutes, and then dispersed by using the Ultimizer, to provide a coloring agent dispersant (4) containing colorant (yellow pigment) particles having an average particle diameter of 250 nm.

Preparation of a Releasing Agent Dispersion 100 parts of a paraffin wax (trade name: HNP0190, manufactured by Nippon Seiro Co., Ltd., melting point 85° C.), 5 parts of a cationic surfactant (trade name: Sanisol B50, manufactured by Kao Corporation), and 240 parts of ion-exchange water are mixed and heated to 95° C., and stirred in a round-bottom stainless steel flask by using a homogenizer (trade name: Ultra-Turrax T50, manufactured by IKA) for 10 minutes, and then dispersed by using a high-pressure extrusion homogenizer, to provide a releasing agent dispersion containing releasing agent particles having an average particle diameter of 550 nm.

Preparation of Toner Mother Particle K1

234 Parts of resin microparticle dispersion, 30 parts of the colorant dispersion (1), 40 parts of the releasing agent dispersion, 1.9 parts of polyaluminum hydroxide (trade name: Paho2S, manufactured by Asada Chemicals), and 600 parts of ion-exchange water are mixed and dispersed in a round-bottom stainless steel flask by using a homogenizer (trade name: Ultra-Turrax T50, manufactured by IKA), and then heated to 55° C. in an heating oil bath while the mixture is stirred in the flask. After the solution is kept at 55° C. for 40 minutes, generation of coagulated particles having a volume-average particle diameter D50 of 5.0 μm is confirmed. After the mixture is further heated in the heating oil bath to a temperature of 56° C. and kept at the same temperature for 2 hours, the volume-average particle diameter D50 of the coagulated particles increases to 6.1 μm. Subsequently, 34 parts of the resin microparticle dispersion is added to the dispersion containing the coagulated particles, and the mixture is heated to a temperature of 50° C. in the heating oil bath and kept at 50° C. for 30 minutes. The pH of the system is adjusted to 7.0 by addition of 1N sodium hydroxide solution into the dispersion containing coagulated particles; the stainless steel flask is tightly sealed; and the mixture is heated while stirred continuously to 80° C. and kept at the same temperature for 4 hours. After the mixture is cooled, reaction products are filtered, washed with ion-exchange water four times, and then freeze-dried, to provide a toner mother particle K1. The volume-average particle diameter D50 of the toner mother particles K1 is 6.5 μm, and the average of shape factors SF1 is 133.

Preparation of Toner Mother Particle C1

A toner mother particle C1 is prepared in the similar manner to the toner mother particle K1, except that the colored particle dispersion (1) is replaced with the colored particle dispersion (2). The volume-average particle diameter D50 of the toner mother particles C1 is 6.6 μm, and the average of shape factors SF1 is 132.

Preparation of Toner Mother Particle M1

A toner mother particle M1 is prepared in the similar manner to the toner mother particle K1, except that the colored particle dispersion (1) is replaced with the colored particle dispersion (3). The volume-average particle diameter D50 of the toner mother particles M1 is 6.4 μm, and the average of shape factors SF1 is 135.

Preparation of Toner Mother Particle Y1

A toner mother particle Y1 is prepared in the similar manner to the toner mother particle K1, except that the colored particle dispersion (1) is replaced with the colored particle dispersion (4). The volume-average particle diameter D50 of the toner mother particles Y1 is 6.6 μm, and the average of shape factors SF1 is 131.

Preparation of Toner Mother Particle K2

234 parts of resin microparticle dispersion, 30 parts of the colorant dispersion (1), 40 parts of releasing agent dispersion, 1.0 part of polyaluminum hydroxide (manufactured by Asada Chemicals, Poso2S), and 600 parts ion-exchange water are mixed and dispersed in a round-bottom stainless steel flask by using a homogenizer (trade name: Ultra-Turrax T50, manufactured by IKA), and then heated to 40° C. in a heating oil bath while the mixture is stirred. After the solution is kept at 40° C. for 30 minutes, generation of coagulated particles having a volume-average particle diameter D50 of 4.8 μm is confirmed. After the mixture is further heated in the heating oil bath to a temperature of 56° C. and kept at the same temperature for 1 hour, the volume-average particle diameter D50 of the coagulated particles increases to 5.4 μm. Subsequently, 26 parts of the resin microparticle dispersion is added to the dispersion containing the coagulated particles, and the mixture is heated to a temperature of 50° C. in the heating oil bath and kept at 50° C. for 30 minutes. The pH of the system is adjusted to 7.0 by addition of 1N sodium hydroxide solution into the dispersion containing the coagulated particles, and after the stainless steel flask is tightly sealed, the mixture is heated to 80° C. while stirred continuously and kept at the same temperature for 4 hours. After the mixture is cooled, reaction products are filtered, washed with ion-exchange water four times, and then freeze-dried, to provide a toner mother particle K2. The volume-average particle diameter D50 of the toner mother particles K2 is 5.8 μm, and the average of shape factors SF1 is 131.

Preparation of Toner Mother Particle K3

A mixture of 100 parts of a polyester resin (linear polyester obtained from terephthalic acid, bisphenol A ethylene oxide adduct, and cyclohexane dimethanol; glass transition temperature Tg: 62° C.; number-average molecular weight Mn: 12,000; and weight-average molecular weight Mw:

32,000), 5 parts of carbon black (trade name: MOGAL®L, manufactured by Cabot Corporation), and 6 parts of carnauba wax is kneaded in an extruder and pulverized in a jet mill. The resulting powders are classified in an air classifier, to give toner mother particles K3 having a volume-average particle diameter D50 of 6.4 μm and an average of shape factors SF1 of 145.

Preparation of Toner Mother Particle K4

A mixture of 100 parts of a polyester resin (linear polyester obtained from terephthalic acid, bisphenol A ethylene oxide adduct, and cyclohexane dimethanol; glass transition temperature Tg: 62° C.; number-average molecular weight Mn: 12,000; and weight-average molecular weight Mw: 32,000), 5 parts of carbon black (trade name: MOGAL®L, manufactured by Cabot Corporation), and 6 parts of carnauba wax is kneaded in an extruder, pulverized in a jet mill, and granulated in hot air by using the Kryptron (trade name, manufactured by Kawasaki Heavy Industries), and then classified in an air classifier, to give toner mother particles K4 having a volume-average particle diameter D50 of 6.3 μm and an average of shape factors SF1 of 128.

Preparation of Toner Mother Particle K5

A mixture of 100 parts of a polyester resin (linear polyester obtained from terephthalic acid, bisphenol A ethylene oxide adduct, and cyclohexane dimethanol; glass transition temperature Tg: 62° C.; number-average molecular weight Mn: 12,000; and weight-average molecular weight Mw: 32,000), 5 parts of carbon black (trade name: MOGAL®L, manufactured by Cabot Corporation), and 6 parts of carnauba wax is kneaded in an extruder, pulverized in a jet mill, and then classified in an air classifier, to give toner mother particles K5 having a volume-average particle diameter D50 of 9.2 μm and an of shape factors SF1 of 144.

Preparation of Toner Mother Particle K6

A mixture of 100 parts polyester resin (linear polyester obtained from terephthalic acid, bisphenol A ethylene oxide adduct, and cyclohexane dimethanol; glass transition temperature Tg: 62° C.; number-average molecular weight Mn: 12,000; and weight-average molecular weight Mw: 32,000), 5 parts of carbon black (trade name: MOGAL®L, manufactured by Cabot Corporation), and 6 parts of carnauba wax is kneaded in an extruder, pulverized in a jet mill, and then granulated in hot air by using the Kryptron (trade name, manufactured by Kawasaki Heavy Industries), and classified in an air classifier, to give toner mother particles K6 having a volume-average particle diameter D50 of 9.0 μm and an average of shape factors SF1 of 127.

Preparation of Higher Alcohol Particle A1

A higher alcohol (trade name: Unirin, manufactured by Toyo-Petrolite) is melt extruded by an extruder at 120° C., pulverized in a jet mill, to give higher alcohol particles A1 having a volume-average particle diameter D50 of 8.4 μm, a 16% weight-average diameter D16 of 5.0 μm, an 84% weight-average diameter D84 of 12.2 μm, and a GSD of 1.56.

Preparation of Higher Alcohol Particle A2

A higher alcohol is melt extruded in the same manner as that in the higher alcohol particles A1, and pulverized in a jet mill, to give higher alcohol particles A2 having a volume-average particle diameter D50 of 10.5 μm, a 16% weight-average diameter D16 of 6.2 μm, an 84% weight-average diameter D84 of 15.2 μm, and a GSD of 1.57.

Preparation of Higher Alcohol Particle A3

A higher alcohol is melt extruded in the same manner as that in the higher alcohol particles A1, pulverized in a jet mill, and classified in an air classifier (trade name: Elbow Jet, manufactured by Nittetsu Mining Co., Ltd.), to give higher alcohol particles A3 having a volume-average particle diameter D50 of 6.0 μm, a 16% weight-average diameter D16 of 4.0 μm, an 84% weight-average diameter D84 of 8.0 μm, and a GSD of 1.41.

Preparation of Higher Alcohol Particle A4

A higher alcohol is melt extruded in the same manner as that in the higher alcohol particles A1, pulverized in a jet mill, and classified in an air classifier (trade name: Elbow Jet, manufactured by Nittetsu Mining Co., Ltd.), to provide a higher alcohol particle A4 having a volume-average particle diameter D50 of 5.0 μm, a 16% weight-average diameter D16 of 3.5 μm, an 84% weight-average diameter D84 of 6.6 μm, and a GSD of 1.37.

Preparation of Higher Alcohol Particle A5

Behenyl alcohol (trade name, manufactured by Nikko Chemicals Co., Ltd.) is pulverized in a jet mill and classified in an air classifier (trade name: Elbow Jet, manufactured by Nittetsu Mining Co., Ltd.), to provide a higher alcohol particles A5 having a volume-average particle diameter D50 of 8.4 μm, a 16% weight-average diameter D16 of 6.2 μm, an 84% weight-average diameter D84 of 11.4 μm, and a GSD of 1.36.

Preparation of Carrier

17 Parts of toluene, 3 parts of a styrene-methacrylate copolymer (component ratio: 40/60), and 0.2 part of carbon black (trade name: R330, manufactured by Cabot Corporation) are mixed for 10 minutes by a stirrer, to provide a carbon black-dispersed solution for forming a coating layer. Subsequently, the coating solution and 100 parts of ferrite particles (volume-average particle diameter: 45 μm) are placed in a vacuum-deairation kneader, stirred at 60° C. for 30 minutes, and dried while the kneader is deairated under reduced pressure and heated, to provide a carrier. The volumetric resistivity of the carrier is $10^{14}$ Ωcm when an electric field of 1,000 V/cm is applied.

Example 1

To 100 parts of the toner mother particle K1, 1.0 part of rutile titanium oxide (volume-average particle diameter: 20 nm; and n-decyltrimethoxysilane modified), 2.0 parts of silica (prepared by gas-phase oxidation; volume-average particle diameter: 40 nm; silicone oil treated; and Wadell sphericity: 0.9), 0.5 part of the higher alcohol particles A1 are added, and the mixture is blended by using a 5-liter Henschel mixer at a peripheral velocity of 30 m/s for 15 minutes, and filtered through a sieve having an opening of 45 μm for removing coarse particles, to provide a toner. In addition, 100 parts of the carrier above and 6 parts of the toner are mixed in a Type-V blender at 40 rpm for 20 minutes, filtered through a sieve having an opening of 212 μm, to provide a developer for developing electrostatic charged images. The amount of the higher alcohol particles having a diameter of the volume-average diameter of toner mother particles or less is shown in Tables 1 and 2.

For calculation of the amount of higher alcohol particles having a diameter of the average particle diameter of toner mother particles or less in the toner, the content of higher alcohol particles having a diameter of the volume-average diameter of toner mother particles or less in the toner may be evaluated from the grain size distributions of the toner mother particles and the higher alcohol particles previously evaluated by using a Coulter counter or the like, or the weight-based grain size distribution of each particle may be calculated by separating colored toner mother particles and white higher alcohol particles from the mixture after addition by means of image analysis of the color images such as toner microscopic images. In this Example, the amount is calculated by employing the former method. In addition, the amount of higher alcohol particles having a diameter of the volume-average diameter of toner mother particles or more is also calculated in a similar manner by employing the former method. (The amounts in the following Examples are calculated in a similar manner.)

Examples 2 to 17 and Comparative Examples 1 to 11

Toners are prepared in the similar manner to Example 1, except that the toner mother particles and the higher alcohol particles added and the addition amounts thereof in Example 1 are change to those shown in the following Tables 1 and 2; and 100 parts of each carrier and 6 parts of respective toners are stirred in a Type-V blender at 40 rpm for 20 minutes and filtered through a sieve having an opening of 212 μm, to give respective developer for developing electrostatic charged images. The amounts of respective higher alcohol particles having a diameter of the average particle diameter of toner mother particles or less are summarized in Tables 1 and 2.

TABLE 1

| | Toner mother particle (100 parts by weight) | | | Higher alcohol particle | | | | |
|---|---|---|---|---|---|---|---|---|
| | Kind | Volume average diameter (μm) | SF1 | Kind | Volume average diameter (μm) | Addition amount (part by weight) | Amount of higher alcohol particles having a diameter of the volume-average diameter of toner mother particles or less (part by weight) | Amount of higher alcohol particles having a diameter of the volume-average diameter of toner mother particles or more (part by weight) |
| Example 1 | K1 | 6.5 | 133 | A1 | 8.4 | 0.5 | 0.15 | 0.35 |
| Example 2 | K1 | 6.5 | 133 | A1 | 8.4 | 0.9 | 0.27 | 0.63 |
| Example 3 | K1 | 6.5 | 133 | A1 | 8.4 | 3.1 | 0.93 | 2.17 |
| Example 4 | K1 | 6.5 | 133 | A2 | 10.5 | 0.9 | 0.16 | 0.74 |
| Example 5 | K1 | 6.5 | 133 | A2 | 10.5 | 1.5 | 0.27 | 1.23 |
| Example 6 | K1 | 6.5 | 133 | A3 | 6.0 | 0.5 | 0.30 | 0.20 |
| Example 7 | K1 | 6.5 | 133 | A3 | 6.0 | 0.3 | 0.18 | 0.12 |
| Example 8 | K1 | 6.5 | 133 | A4 | 5.0 | 0.5 | 0.42 | 0.09 |
| Example 9 | K1 | 6.5 | 133 | A4 | 5.0 | 0.2 | 0.17 | 0.03 |
| Example 10 | K1 | 6.5 | 133 | A4 | 5.0 | 5 | 4.15 | 0.85 |
| Example 11 | K1 | 6.5 | 133 | A5 | 8.4 | 0.9 | 0.18 | 0.72 |
| Example 12 | K2 | 5.8 | 131 | A1 | 8.4 | 0.9 | 0.21 | 0.69 |
| Example 13 | K4 | 6.3 | 128 | A1 | 8.4 | 0.6 | 0.15 | 0.40 |
| Example 14 | K4 | 6.3 | 128 | A1 | 8.4 | 0.9 | 0.25 | 0.65 |
| Example 15 | K6 | 9 | 127 | A1 | 8.4 | 0.3 | 0.17 | 0.13 |

TABLE 2

| | Toner mother particle (100 parts by weight) | | | Higher alcohol particle | | | | |
|---|---|---|---|---|---|---|---|---|
| | Kind | Volume average diameter (μm) | SF1 | Kind | Volume average diameter (μm) | Addition amount (part by weight) | Amount of higher alcohol particles having a diameter of the volume-average diameter of toner mother particles or less (part by weight) | Amount of higher alcohol particles having a diameter of the volume-average diameter of toner mother particles or more (part by weight) |
| Example 16 | K1 | 6.5 | 133 | A1 | 8.4 | 5 | 1.50 | 3.50 |
| Example 17 | K1 | 6.5 | 133 | A2 | 10.5 | 3.1 | 0.56 | 2.54 |
| Comparative example 1 | K1 | 6.5 | 133 | A1 | 8.4 | 0.3 | 0.09 | 0.21 |
| Comparative example 2 | K1 | 6.5 | 133 | A2 | 10.5 | 0.5 | 0.09 | 0.41 |
| Comparative example 3 | K1 | 6.5 | 133 | A3 | 6.0 | 0.2 | 0.12 | 0.08 |
| Comparative example 4 | K1 | 6.5 | 133 | A4 | 5.0 | 0.1 | 0.08 | 0.02 |
| Comparative example 5 | K1 | 6.5 | 133 | A5 | 8.4 | 0.5 | 0.10 | 0.40 |
| Comparative example 6 | K2 | 5.8 | 131 | A1 | 8.4 | 0.5 | 0.12 | 0.39 |
| Comparative example 7 | K3 | 6.4 | 145 | A1 | 8.4 | 0.6 | 0.16 | 0.39 |
| Comparative example 8 | K3 | 6.4 | 145 | A1 | 8.4 | 0.9 | 0.26 | 0.64 |
| Comparative example 9 | K5 | 9.2 | 144 | A1 | 8.4 | 0.3 | 0.15 | 0.11 |
| Comparative example 10 | K5 | 9.2 | 144 | A1 | 8.4 | 0.5 | 0.29 | 0.21 |
| Comparative example 11 | K6 | 9 | 127 | A1 | 8.4 | 0.3 | 0.14 | 0.11 |

The developing property and transferring property of the developers are evaluated by using the respective developers above in a printing machine (trade name: DocuPrint C2221, manufactured by Fuji Xerox Co., Ltd.), according to the following method:

Initial Developing Property and Transferring Property

Under an environment at high temperature and high humidity (30° C., 80% RH), a 5 cm×2 cm solid patch is developed by using each color toner, and the toner image developed on the photoreceptor surface is transferred onto the surface of an adhesive tape by using the adhesiveness thereof, and the weight of the transferred image (W1) is evaluated. Subsequently, a similarly developed toner image is transferred onto the surface of a paper (trade name: J Paper, manufactured by Fuji Xerox Office Supply Co., Ltd.), and the weight of the transferred image (W2) is evaluated. The transferring property is evaluated by determining the transfer efficiency from these weights according to the following formula:

$$\text{Transfer efficiency (\%)}=(W2/W1)\times 100$$

The developing property is evaluated based on the weight W1 in the same test.

Criteria in Evaluating Developing Property

A: W1, 4.5 g/m$^2$ or more.

B: W1, 4.0 or more and less than 4.5 g/m$^2$.

C: W1, less than 4.0 g/m$^2$.

Criteria in Evaluating Transferring Property (Transfer Efficiency)

A: Transfer efficiency, 90% or more.

B: Transfer efficiency, 85% or more and less than 90%.

C: Transfer efficiency, less than 85%.

Criteria in Evaluating Transfer Irregularity

A: No irregularity in half tone images by visual observation.

B: Some irregularities in half tone images, but practically no problem.

C: Many irregularities in half tone images by visual observation.

The results are summarized in Tables 3 and 4.

Cleaning Property

The cleaning property is evaluated by using the developers above in a printing machine (trade name: DocuCenter Color 500, manufactured by Fuji Xerox Co., Ltd.). After printing 200,000 copies under a high-temperature and high-humidity condition (30° C. and 80% RH), the damage of images by deletion, the staining of electrostatic charging device due to improper cleaning, and the deterioration in image quality are evaluated, and then after additionally printing 30,000 copies on J Papers (trade name, manufactured by Fuji Xerox Office Supply Co., Ltd.) under an environment of low temperature and low humidity (10° C. and 20% RH), the staining of electrostatic charging device due to improper cleaning and the deterioration in image quality are evaluated. The amounts of the abrasion of photoreceptor during the printing are also examined.

Criteria for evaluation are as follows:

Criteria in Evaluating Cleaning Property

A: No deterioration in image quality, no problems other than in image quality.

B: No deterioration in image quality, but some problems other than in image quality.

C: Deterioration in image quality.

The results are summarized in the following Tables 3 and 4.

Criteria in Evaluating the Abrasion of Photoreceptor

A: No deterioration in image quality, no other problems than in image quality.

B: Some deterioration in image quality, not in photoreceptor life.

C: Deterioration in image quality and other defects.

The results are summarized in the following Tables 3 and 4.

TABLE 3

| | Developing property | | Transfer efficiency (%) | | Transfer irregularity | Cleaning property (high temperature and high humidity) | | Cleaning property (low temperature and low humidity) | |
|---|---|---|---|---|---|---|---|---|---|
| Example 1 | 5 | A | 96.7 | A | A | No problem | A | No problem | A |
| Example 2 | 5.1 | A | 97.8 | A | A | No problem | A | No problem | A |
| Example 3 | 5.2 | A | 97.6 | A | A | No problem | A | No problem | A |
| Example 4 | 5.2 | A | 98.6 | A | A | No problem | A | No problem | A |
| Example 5 | 5.1 | A | 97.9 | A | A | No problem | A | No problem | A |
| Example 6 | 5.3 | A | 96.9 | A | A | No problem | A | No problem | A |
| Example 7 | 5.1 | A | 98.1 | A | A | No problem | A | No problem | A |
| Example 8 | 5.1 | A | 97.2 | A | A | No problem | A | No problem | A |
| Example 9 | 5.2 | A | 97.6 | A | A | No problem | A | No problem | A |
| Example 10 | 5.3 | A | 98.2 | A | A | No problem | A | No problem | A |
| Example 11 | 5.1 | A | 98.6 | A | A | No problem | A | No problem | A |
| Example 12 | 4.9 | A | 95.8 | A | A | No problem | A | No problem | A |
| Example 13 | 4.5 | A | 98.2 | A | A | No problem | A | No problem | A |
| Example 14 | 4.6 | A | 97.8 | A | A | No problem | A | No problem | A |
| Example 15 | 5.6 | A | 99.3 | A | A | No problem | A | No problem | A |

TABLE 4

| | Developing property | | Transfer efficiency (%) | | Transfer irregularity | Cleaning property (high temperature and high humidity) | | Cleaning property (low temperature and low humidity) | |
|---|---|---|---|---|---|---|---|---|---|
| Example 16 | 5 | A | 97.7 | A | B | No problem | A | No problem | A |
| Example 17 | 5.2 | A | 98.3 | A | B | No problem | A | No problem | A |

TABLE 4-continued

| | Developing property | | Transfer efficiency (%) | | Transfer irregularity | Cleaning property (high temperature and high humidity) | | Cleaning property (low temperature and low humidity) | |
|---|---|---|---|---|---|---|---|---|---|
| Comparative example 1 | 5 | A | 98.1 | A | A | Improper cleaning | C | Improper cleaning. BCO due to the abrasion of photoreceptor | C |
| Comparative example 2 | 5.3 | A | 97.4 | A | A | Improper cleaning | C | Improper cleaning. BCO due to the abrasion of photoreceptor | C |
| Comparative example 3 | 5 | A | 98.3 | A | A | No problem | A | BCO due to the abrasion of photoreceptor | C |
| Comparative example 4 | 5.3 | A | 97.9 | A | A | Improper cleaning | C | Improper cleaning. BCO due to the abrasion of photoreceptor | C |
| Comparative example 5 | 5.3 | A | 98.2 | A | A | Improper cleaning | C | Improper cleaning. BCO due to the abrasion of photoreceptor | C |
| Comparative example 6 | 4.8 | A | 96.5 | A | A | No problem | A | BCO due to the abrasion of photoreceptor | C |
| Comparative example 7 | 4.2 | B | 80.2 | C | A | No problem | A | No problem | A |
| Comparative example 8 | 4.3 | B | 80.9 | C | A | No problem | A | No problem | A |
| Comparative example 9 | 5.2 | A | 84.2 | C | A | No problem | A | Indefinite thin lines due to the abrasion of photoreceptor | B |
| Comparative example 10 | 5.1 | A | 83.8 | C | A | No problem | A | No problem | A |
| Comparative example 11 | 5.5 | A | 99.4 | A | A | No problem | A | Indefinite thin lines due to the abrasion of photoreceptor | B |

As apparent from the results in Tables 3 and 4, the developer for developing electrostatic charged images in Examples are superior in developing property, transfer efficiency, transfer irregularity, and cleaning property. In particular, the developer for developing electrostatic charged images of Examples 1 to 15, wherein the content of higher alcohol particles having a diameter of the volume-average diameter of toner mother particles or more is reduced to 2.5 parts or less with respect to 100 parts by weight of toner mother particles, completely eliminates the incidence of transfer irregularity.

Example 18

To 100 parts of the toner mother particle K1, 1.0 part of rutile titanium oxide (volume-average particle diameter: 20 nm; and n-decyltrimethoxysilane modified), 2.0 parts of silica (prepared by gas-phase oxidation; volume-average particle diameter: 40 nm, silicone oil modified; and Wadell sphericity: 0.9), and 0.5 part of the higher alcohol A1 are added, and the mixture is blended by using a 5-liter Henschel mixer at a peripheral velocity of 30 m/s for 15 minutes, and filtered through a sieve having an opening of 45-μm for removal of coarse particles, to provide a toner. In addition, 100 parts of the carrier above and 6 parts of the toner are mixed in a Type-V blender at 40 rpm for 20 minutes, filtered through a sieve having an opening of 212 μm, to provide a developer for developing electrostatic charged images.

In the similar manner to above, to 100 parts of the toner mother particles C1, M1, or Y1, 1.0 part of rutile titanium oxide (volume-average particle diameter: 20 nm; and n-decyltrimethoxysilane modified), 2.0 parts of silica (prepared by gas-phase oxidation; volume-average particle diameter: 40 nm; silicone oil treated), 0.5 part of the higher alcohol particle A1 are added, and the mixture is blended by using a 5-liter Henschel mixer, at a peripheral velocity of 30 m/s for 15 minutes, and filtered through a sieve having an opening of 45 μm for removing coarse particles, to provide a toner. Then, 100 parts of the respective carriers above and 6 parts of the toner are mixed in a Type-V blender at 40 rpm for 20 minutes, filtered through a sieve having an opening of 212 μm, to give developers in cyan, magenta, and yellow for full color electrophotographic imaging. The amounts of higher alcohol particles having a diameter of the volume-average diameter of toner mother particles or less are summarized in Table 5.

Examples 19 to 23 and Comparative Example 12

Toners are prepared in the similar manner to Example 18, except that the higher alcohol and the addition amount thereof used in the preparation of the toner mother particles in Example 18 are changed to those shown in Tables 3 and 4, and 100 parts the carrier above and 6 parts of respective toners are stirred in a Type-V blender at 40 rpm for 20 minutes and screened through a sieve having an opening of 212 μm, to give full color developer for developing electrostatic charged images. The amounts of higher alcohol particles having a diameter of the average particle diameter of toner mother particles or less are summarized in the following Table 5 and 6.

TABLE 5

| | Toner mother particle (100 part by weight) | | | Higher alcohol particle | | | | |
|---|---|---|---|---|---|---|---|---|
| | Kind | Volume-average Particle diameter (μm) | SF1 | Kind | Volume average diameter (μm) | Addition amount (part by weight) | Amount of higher alcohol particles having a diameter of the volume-average diameter of toner mother particles or less (part by weight) | Amount of higher alcohol particles having a diameter of the volume-average diameter of toner mother particles or more (part by weight) |
| Example 18 | K1 | 6.5 | 133 | A1 | 8.4 | 0.5 | 0.15 | 0.35 |
| | C1 | 6.6 | 132 | A1 | 8.4 | 0.5 | 0.16 | 0.35 |
| | M1 | 6.4 | 135 | A1 | 8.4 | 0.55 | 0.16 | 0.39 |
| | Y1 | 6.6 | 131 | A1 | 8.4 | 0.5 | 0.16 | 0.35 |

TABLE 5-continued

| | Toner mother particle (100 part by weight) | | | Higher alcohol particle | | | | |
|---|---|---|---|---|---|---|---|---|
| | Kind | Volume-average Particle diameter (μm) | SF1 | Kind | Volume average diameter (μm) | Addition amount (part by weight) | Amount of higher alcohol particles having a diameter of the volume-average diameter of toner mother particles or less (part by weight) | Amount of higher alcohol particles having a diameter of the volume-average diameter of toner mother particles or more (part by weight) |
| Example 19 | K1 | 6.5 | 133 | A1 | 8.4 | 2.6 | 0.78 | 1.82 |
| | C1 | 6.6 | 132 | A1 | 8.4 | 2.6 | 0.81 | 1.79 |
| | M1 | 6.4 | 135 | A1 | 8.4 | 2.6 | 0.75 | 1.85 |
| | Y1 | 6.6 | 131 | A1 | 8.4 | 2.6 | 0.81 | 1.79 |
| Example 20 | K1 | 6.5 | 133 | A4 | 5.0 | 0.5 | 0.42 | 0.09 |
| | C1 | 6.6 | 132 | A4 | 5.0 | 0.5 | 0.43 | 0.08 |
| | M1 | 6.4 | 135 | A4 | 5.0 | 0.5 | 0.41 | 0.10 |
| | Y1 | 6.6 | 131 | A4 | 5.0 | 0.5 | 0.43 | 0.08 |
| Example 21 | K1 | 6.5 | 133 | A1 | 5.0 | 3 | 2.49 | 0.51 |
| | C1 | 6.6 | 132 | A1 | 5.0 | 3 | 2.55 | 0.45 |
| | M1 | 6.4 | 135 | A1 | 5.0 | 3 | 2.43 | 0.57 |
| | Y1 | 6.6 | 131 | A1 | 5.0 | 3 | 2.55 | 0.45 |

TABLE 6

| | Toner mother particle (100 part by weight) | | | Higher alcohol particle | | | | |
|---|---|---|---|---|---|---|---|---|
| | Kind | Volume-average particle diameter (μm) | SF1 | Kind | Volume average diameter (μm) | Addition amount (part by weight) | Amount of higher alcohol particles having a diameter of the volume-average diameter of toner mother particles or less (part by weight) | Amount of higher alcohol particles having a diameter of the volume-average diameter of toner mother particles or more (part by weight) |
| Example 22 | K1 | 6.5 | 133 | A1 | 8.4 | 3 | 0.90 | 2.10 |
| | C1 | 6.6 | 132 | A1 | 8.4 | 3 | 0.93 | 2.07 |
| | M1 | 6.4 | 135 | A1 | 8.4 | 3 | 0.87 | 2.13 |
| | Y1 | 6.6 | 131 | A1 | 8.4 | 3 | 0.93 | 2.07 |
| Example 23 | K1 | 6.5 | 133 | A5 | 8.4 | 2.6 | 0.52 | 2.08 |
| | C1 | 6.6 | 132 | A5 | 8.4 | 2.6 | 0.55 | 2.05 |
| | M1 | 6.4 | 135 | A5 | 8.4 | 2.6 | 0.49 | 2.11 |
| | Y1 | 6.6 | 131 | A5 | 8.4 | 2.6 | 0.55 | 2.05 |
| Comparative Example 12 | K1 | 6.5 | 133 | A5 | 8.4 | 0.5 | 0.10 | 0.40 |
| | C1 | 6.6 | 132 | A5 | 8.4 | 0.5 | 0.11 | 0.40 |
| | M1 | 6.4 | 135 | A5 | 8.4 | 0.5 | 0.10 | 0.41 |
| | Y1 | 6.6 | 131 | A5 | 8.4 | 0.5 | 0.11 | 0.40 |

The developing property and transferring property of respective developers are evaluated in a printing machine (trade name: DocuPrint C2221, manufactured by Fuji Xerox Co., Ltd.) according to the methods above. The developing property and the transfer efficiency are averages of those of four color developers. For evaluation of the transfer irregularity, the worst value observed in the weight of the images in Red, Green, Blue, and respective secondary colors is used.

Initial Developing Property and Transferring Property

Under an environment at high temperature and high humidity (30° C., 80% RH), a 5 cm×2 cm solid patch is developed by using each color toner, and the toner image developed on the photoreceptor surface is transferred onto the surface of an adhesive tape by using the adhesiveness thereof, and the weight of the transferred image (W1) is evaluated. Subsequently, a similarly developed toner image is transferred onto the surface of a paper (trade name: J Paper, manufactured by Fuji Xerox Office Supply Co., Ltd.), and the weight of the transferred image (W2) is evaluated.

The transferring property is evaluated by determining the transfer efficiency from these weights according to the following formula:

$$\text{Transfer efficiency (\%)}=(W2/W1)\times 100$$

In addition, the developing property is evaluated from the value of

Criteria in evaluating developing property

A: W1, 4.5 g/m$^2$ or more.

B: W1, 4.0 or more and less than 4.5 g/m$^2$.

C: W1, less than 4.0 g/m$^2$.

Criteria in Evaluating Transfer Efficiency

A: Transfer efficiency, 90% or more.

B: Transfer efficiency, 85% or more and less than 90%.

C: Transfer efficiency, less than 85%.

Criteria in Evaluating Transfer Irregularity

A: Visually no irregularity in half tone images.

B: Visually some irregularity in half tone images, but practically no problem.

C: Visually many irregularities in half tone image.

The results are summarized in the following Table 7.

TABLE 7

| | Developing property | | Transfer efficiency (%) | | Transfer irregularity | Cleaning property (high temperature and high humidity) | | Cleaning property (low temperature and low humidity) | |
|---|---|---|---|---|---|---|---|---|---|
| Example 18 | 5.2 | A | 97.8 | A | A | No problem | A | No problem | A |
| Example 19 | 5.1 | A | 98 | A | A | No problem | A | No problem | A |
| Example 20 | 5.3 | A | 97.6 | A | A | No problem | A | No problem | A |
| Example 21 | 5.2 | A | 98.6 | A | A | No problem | A | No problem | A |
| Example 22 | 5 | A | 98.1 | A | B | No problem | A | No problem | A |
| Example 23 | 5.1 | A | 97.9 | A | B | No problem | A | No problem | A |
| Comparative example 12 | 5.3 | A | 98.1 | A | A | Improper cleaning | C | Improper cleaning. BCO due to the abrasion of photoreceptor | C |

Evaluation of Cleaning Property

The cleaning property is evaluated by using the developers above in a printing machine (trade name: DocuCenter Color 500, manufactured by Fuji Xerox Co., Ltd.). Under a high-temperature and high-humidity environment (30° C., 80% RH), 200,000 copies of prints are formed, the irregularity in images by deletion, the staining of electrostatic charging device due to improper cleaning, and the deterioration in image quality are evaluated, and then, under a low temperature and low humidity environment (10° C., 20% RH), 30,000 copies of prints are additionally formed by using J Papers (trade name, manufactured by Fuji Xerox Office Supply Co., Ltd.), and the staining of electrostatic charging device due to improper cleaning and the deterioration in image quality are evaluated. The amounts of the abrasion of photoreceptor during the printing are also examined.

Criteria for evaluation are as follows:

Criteria in Evaluating Cleaning Property

A: No deterioration in image quality, no problems other than in image quality.

B: No deterioration in image quality, but some problems other than in image quality.

C: Deterioration in image quality.

The results are summarized in Tables 7.

Criteria in Evaluating the Abrasion of Photoreceptor

A: No deterioration in image quality, no other problems than in image quality.

B: Some deterioration in image quality, not in photoreceptor life.

C: Deterioration in image quality and other defects.

The results are summarized in the Table 7 above.

As is apparent from the results in Table 7, the developer for developing electrostatic charged images in Examples 18 to 23 are superior in developing property, transfer efficiency, transfer irregularity, and cleaning property. In particular, the developer for developing electrostatic charged images of Examples 18 to 21, wherein the content of higher alcohol particles having a diameter of the volume-average diameter of toner mother particles or more is reduced to 2.0 parts or less with respect to 100 parts by weight of toner mother particles, completely eliminates the incidence of transfer irregularity.

What is claimed is:

1. A toner for developing electrostatic images comprising toner mother particles, and an external additive, wherein:

the average of shape factors SF1 of the toner mother particles represented by the following Formula (1) is 140 or less;

the external additive contains higher alcohol particles having a volume-average particle diameter of 1 to 12 μm; and the content of the higher alcohol particles having a diameter equal to or less than the volume-average particle diameter of the toner mother particles is in a range of 0.15 to 2.5 parts by weight with respect to 100 parts by weight of the toner mother particles:

$$SF1=(L^2/A)\times(\pi/4)\times 100 \qquad \text{Formula (1)}$$

wherein L represents the maximum length of each toner mother particle; and A represents the projected area of each toner mother particle.

2. A toner according to claim 1, wherein the average of shape factor SF1 of the higher alcohol particles is equal to or more than 140.

3. A toner according to claim 1, wherein the higher alcohol particles has 16 to 150 carbon atoms.

4. A toner according to claim 1, wherein a preparation of the higher alcohol particles includes pulverization.

5. A toner according to claim 1, wherein a volume-average particle diameter of the toner mother particles is 2 to 12 μm.

6. A toner according to claim 1, further including inorganic oxide particles having a volume-average particle diameter of 20 to 300 nm.

7. A toner according to claim 1, further including monodisperse spherical silica having a true specific density of 1.3 to 1.9 and a volume-average particle diameter of 80 to 300 nm.

8. A toner according to claim 1, further including monodisperse spherical silica, the standard deviation of which is a value of volume-average particle diameter D50 multiplied by 0.22 or less.

9. A toner according to claim 1, further including monodisperse spherical silica, the Wadell sphericity of which is 0.6 or more.

10. A developer for developing electrostatic charged images comprising a toner for developing electrostatic charged images, wherein:

the toner comprises at least toner mother particles containing a binder resin and a colorant, and an external additive;

the average of the shape factors SF1 of the toner mother particles represented by the following Formula (1) is 140 or less;

the external additive further comprises higher alcohol particles having a volume-average particle diameter 1 to 12 μm; and the content of the higher alcohol particles having a diameter equal to or less than the volume-average particle diameter of the toner mother particles is in a range of 0.15 to 2.5 parts by weight with respect to 100 parts by weight of the toner mother particles:

$$SF=(L^2/A)\times(\pi/4)\times 100 \quad \text{Formula (1)}$$

wherein L represents the maximum length of each toner mother particle; and A represents the projected area of each toner mother particle.

11. A developer according to claim 10, further comprising a resin-coated carrier.

12. A developer according to claim 10, further comprising a carrier having the volume-average particle diameter of core materials of 10 to 100 μm.

13. An image forming method using a toner for developing electrostatic charged images, comprising:

charging a photoreceptor to form a latent image on a latent image bearing body;

developing the latent image on a developer bearing body by using the toner for developing electrostatic charged images and transferring the developed image; and cleaning comprising removing the remaining toner on the latent image bearing body, wherein the toner comprises at least toner mother particles containing a binder resin and a colorant, and an external additive;

the average of the shape factors SF1 of the toner mother particles represented by the following Formula (1) is 140 or less;

the external additive further comprises higher alcohol particles having a volume-average particle diameter 1 to 12 μm; and the content of the higher alcohol particles having a diameter equal to or less than the volume-average particle diameter of the toner mother particles is in a range of 0.15 to 2.5 parts by weight with respect to 100 parts by weight of the toner mother particles:

$$SF1=(L^2/A)\times(\pi/4)\times 100 \quad \text{Formula (1)}$$

wherein L represents the maximum length of each toner mother particle; and A represents the projected area of each toner mother particle.

14. An image forming method according to claim 13, wherein charging is conducted by contact-type electrostatic charging.

15. An image forming method according to claim 13, wherein cleaning is conducted by blade cleaning.

* * * * *